US008422935B2

(12) United States Patent
Tanigami

(10) Patent No.: US 8,422,935 B2
(45) Date of Patent: Apr. 16, 2013

(54) IMAGE FORMING SYSTEM AND PAMPHLET PRODUCING METHOD

(75) Inventor: Shinya Tanigami, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1221 days.

(21) Appl. No.: 12/002,510

(22) Filed: Dec. 17, 2007

(65) Prior Publication Data

US 2008/0205955 A1 Aug. 28, 2008

(30) Foreign Application Priority Data

Feb. 27, 2007 (JP) ..... 2007-046881

(51) Int. Cl.
*G03G 15/00* (2006.01)

(52) U.S. Cl.
USPC ..... 399/407; 270/4; 270/5.01; 270/8; 270/41; 493/430

(58) Field of Classification Search ..... 399/407; 270/4, 5.01, 8, 41; 493/430
See application file for complete search history.

(56) References Cited

U.S. PATENT DOCUMENTS

| | | | | |
|---|---|---|---|---|
| 6,526,256 | B2 * | 2/2003 | Yoshie et al. | 399/407 |
| 6,895,212 | B2 * | 5/2005 | Yamakawa et al. | 399/407 |
| 2005/0232656 | A1 * | 10/2005 | Asai et al. | 399/130 |
| 2007/0228632 | A1 * | 10/2007 | Sato et al. | 270/52.18 |

FOREIGN PATENT DOCUMENTS

| | | | |
|---|---|---|---|
| JP | 48-029517 | A | 4/1973 |
| JP | 4-369590 | A | 12/1992 |
| JP | 6-144700 | A | 5/1994 |
| JP | 2003-063735 | A | 3/2003 |
| JP | 2003-063736 | A | 3/2003 |
| JP | 2004-189413 | A | 7/2004 |
| JP | 2004-338918 | A | 12/2004 |
| JP | 2005-305822 | A | 11/2005 |
| JP | 2007-045621 | A | 2/2007 |

OTHER PUBLICATIONS

Japanese Office Action dated Apr. 5, 2011 (and English translation thereof) in counterpart Japanese Application No. 2007-046881.

Japanese Office Action dated Nov. 22, 2011 (and English translation thereof) in counterpart Japanese Application No. 2007-046881.

Japanese Office Action dated Oct. 2, 2012 (and English translation thereof) in counterpart Japanese Application No. 2007-046881.

* cited by examiner

*Primary Examiner* — Matthew G Marini
*Assistant Examiner* — Andy Pham
(74) *Attorney, Agent, or Firm* — Holtz, Holtz, Goodman & Chick, P.C.

(57) ABSTRACT

In an image forming system equipped with a small-sized post-processing apparatus capable of producing pamphlets without being limited in terms of the number of sets, a folding device, an interposing device and an ejecting device for ejecting a pamphlet formed by interposing a sheet into a sheet to be folded are provided in the post-processing apparatus.

10 Claims, 20 Drawing Sheets

IMAGE FORMING SYSTEM AND PAMPHLET PRODUCING METHOD

This application is based on Japanese Patent Application No. 2007-046881 filed on Feb. 27, 2007 in Japanese-Patent Office, the entire content of which is hereby incorporated by reference.

BACKGROUND OF THE INVENTION

The present invention relates to a technology to produce a pamphlet while forming images on a sheet.

There is widely used an image forming system wherein a post-processing apparatus is connected to an image forming apparatus, whereby, images are formed on a sheet by the image forming apparatus and various post-processes are performed on the sheet having thereon the formed images, and Patent Document 1 discloses an image forming system wherein center-folded sheets are ejected to multiple arranged bins, and a sheet to be interposed is sent to the sheet housed in the bin to be interposed in the folded sheet, and thus, a pamphlet is produced.

In the image forming system in the Patent Document 1, a sheet is housed in the bin after being center-folded, and a sheet is interposed in the bin. Therefore, when producing a large number of pamphlets, many bins are needed, and a sheet ejection section of a post-processing apparatus needs to be large in size, which is a problem.

Further, the number of sets of pamphlet is restricted by the number of bins, which causes a problem that a large number of pamphlets cannot be produced.

[Patent Document 1] Japanese Patent Publication Open to Public Inspection No. 6-144700

SUMMARY

An aspect of the present invention is as follows.

1. An image forming system having therein an image forming apparatus that forms images on a sheet and a post-processing apparatus that conducts processing for the sheet having thereon the formed images, wherein the aforesaid image forming apparatus forms images for each set of sheets constituting a pamphlet, and the aforesaid post-processing apparatus has therein a folding device that folds a sheet, an interposing device that superimposes a sheet to be interposed in a folded sheet and a sheet-ejection device that ejects a pamphlet produced with a sheet to be interposed in the folded sheet.

2. A pamphlet producing method, comprising the steps of: forming images on at least a sheet to be interposed for each set of sheets constituting a pamphlet; conveying sheets to be folded; conveying the sheet to be interposed; aligning the sheet to be folded and the sheet to be interposed; producing pamphlets by folding sheets to be folded while interposing the sheet to be interposed in the folded sheet; and ejecting a pamphlet.

DETAILED DESCRIPTION OF THE PREFERRED EMBODIMENTS

There will be described the invention based on the embodiment of the invention of the present application, to which, however, the invention is not limited.

Figure 1:
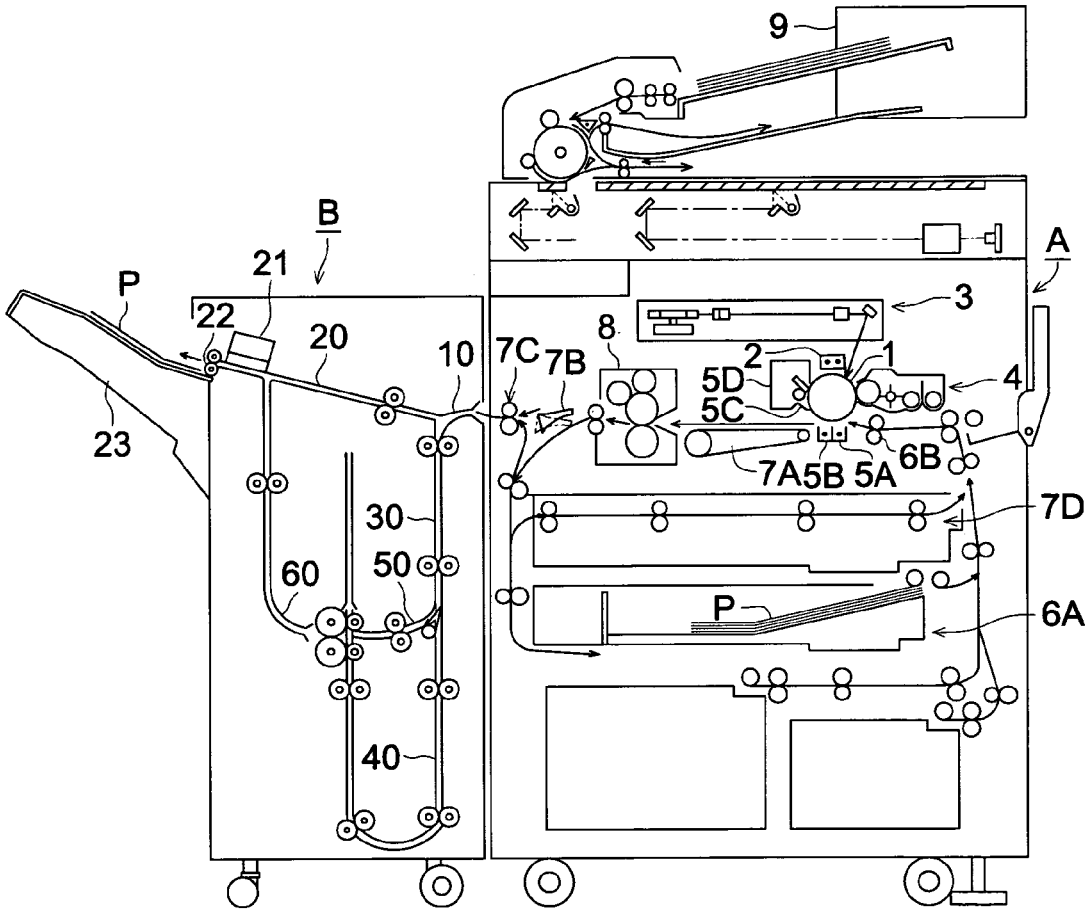
FIG. 1 is an overall view of the image forming system relating to the embodiment of the invention.

FIG. 1 is an overall view of the image forming system relating to the embodiment of the invention.

[Image Forming Apparatus]

Image forming apparatus A has an image forming section wherein there are arranged charging unit 2, image exposure unit (writing device) 3, developing unit 4, transfer unit 5A, neutralizing unit 5B, separating claw 5C and cleaning unit 5D on the circumstance of a rotating photoconductor 1, and exposure scanning is conducted based on image data read out of a document by a laser beam of image exposure apparatus 3, after conducting uniform charging on the surface of photoconductor 1 with the charging unit 2, to form a latent image, and a toner image is formed on the surface of photoconductor 1 through reversal development for the latent image by developing unit 4.

On the other hand, sheet P fed from sheet supply section 6A is conveyed to a transfer position through intermediate sheet feed section 6B. The aforesaid toner image is transferred onto sheet P by transfer unit 5A at the transfer position. After that, electric charges on the reverse side of the sheet P is eliminated by neutralizing unit 5B, then, the sheet P is separated from photoconductor 1 by separating claw 5C, and is conveyed by conveyance device 7A, and passes through fixing unit 8 continually to be ejected on sheet ejection roller 7C. A toner image on the sheet P is heated and fixed in the course of passing through fixing unit 8.

The sheet P which has passed through the fixing unit 8 is guided by conveyance path switching plate 7B.

In the case of face-up sheet ejection with an image carrying surface facing upward, the sheet P which has passed through the fixing unit 8 advances horizontally to be ejected.

In the case of face-down sheet ejection with an image carrying surface facing downward, the sheet P which has passed through the fixing unit 8 advances downward, and goes up on a switchback basis to be ejected after both the faces are reversed.

On the other hand, the surface of photoconductor 1 is cleaned by cleaning unit 5D after the transferring at a location that is a downstream side of separating claw 5C, to be ready for the succeeding image forming.

When conducting image forming on both sides of sheet P, the sheet P which has been subjected to fixing processing by fixing unit 8 is branched from an ordinary sheet ejection path by conveyance path switching plate 7B, then, is reversed on a switchback basis at reverse conveyance device 7D, and is ejected out of the apparatus by ejection roller 7C, with a toner surface (image surface) that is facing downward. The sheet P ejected from the ejection roller 7C is sent into entrance section 10 of sheet post-processing apparatus B.

On the upper part of image forming apparatus A, there is arranged operation section 9 representing a selection device that selects an image forming mode or a sheet post-processing mode to set it.

[Sheet Post-Processing Apparatus]

Embodiment 1

Post-processing apparatus B has therein entrance section 10, horizontal conveyance section 20, vertical conveyance sections 30 and 40, bypass conveying section 50 representing an interposing device, folding conveyance section 60 representing a folding device, sheet-ejection roller 22 and sheet-ejection tray 23 representing an ejection device.

The sheet P conveyed into entrance section 10 is conveyed to horizontal conveyance section 20, or to vertical conveyance sections 30. When post-processing is not carried out for sheet P, or when punch processing or shift processing is carried out for sheet P, the sheet P is conveyed to the horizontal conveyance section 20.

The numeral 21 represents a post-process section that conducts punch processing and shift processing.

Sheet P is conveyed to vertical conveyance section 30 when folding process is conducted for the sheet P.

The folding process includes an occasion where folding process only is conducted for sheet P conveyed in from an image forming apparatus, and an occasion where a pamphlet is produced by interposing sheet P in folded sheet P.

Figure 2:
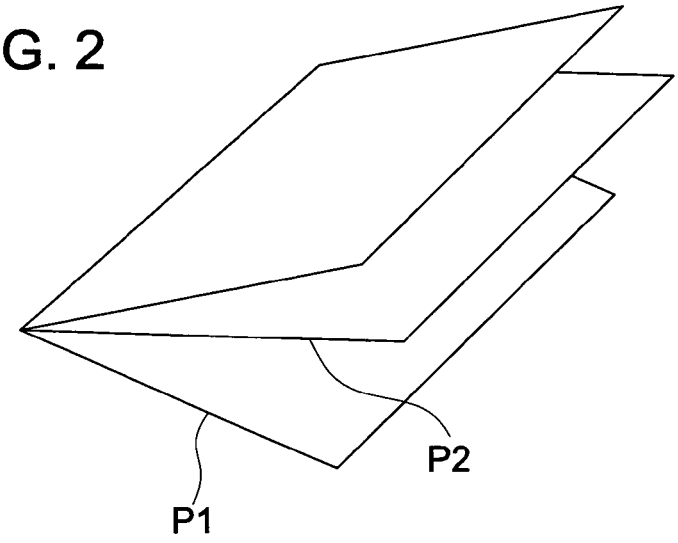
FIG. 2 is a diagram showing a pamphlet.

In the present specification, a pamphlet means one shown in FIG. 2.

To be more specific, a bundle of sheets wherein sheet P2 is interposed in the center-folded sheets P1 is a pamphlet. The sheet P2 is composed of a single sheet or plural sheets. Further, sheet P1 is folded on its center line in many cases, but it is sometimes folded at a location shifted from the center.

In the case of simple folding process, the sheet P which has been conveyed vertically is conveyed from vertical conveying section 40 to folding conveyance section 60 where the sheet P is ejected to sheet-ejection tray 23 from sheet-ejection roller 22 through horizontal conveyance section 20.

In the case of producing a pamphlet, sheet P1 to be folded is conveyed through vertical conveyance sections 30 and 40, to folding conveyance section 60 where the sheet P1 is stopped temporarily under the condition of preparation for folding.

Next, sheet P2 to be interposed is conveyed through vertical conveyance section 30, and through bypass conveying section 50, to join sheet P1 to be folded that is under suspension.

In the folding conveyance section 60, sheet P1 to be folded and sheet P2 to be interposed are conveyed together, to be ejected to sheet-ejection tray 23 by sheet-ejection roller 22 through horizontal conveyance section 20.

Figure 3:
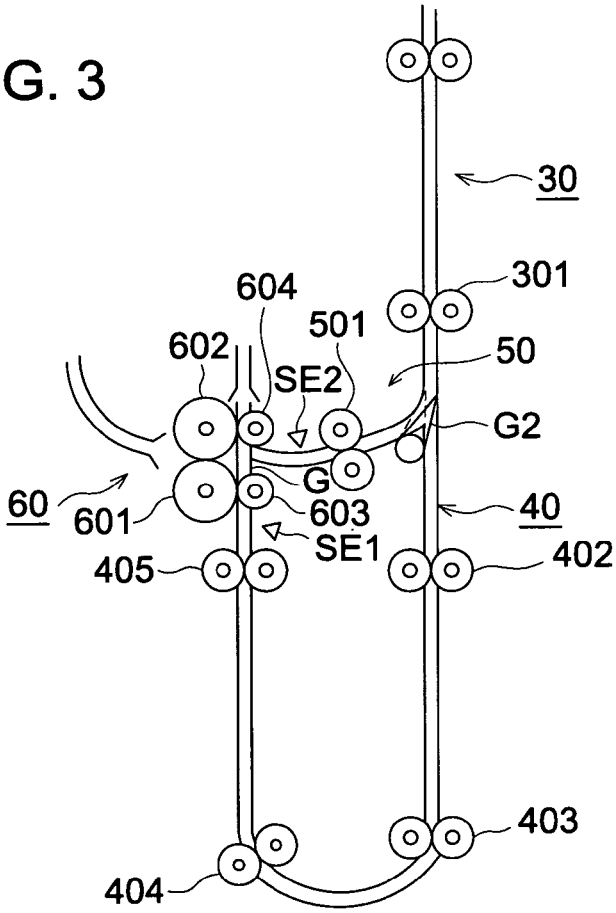
FIG. 3 is a diagram showing vertical conveying sections 30 and 40, bypass conveying section 50 and folding conveyance section 60.

FIG. 3 shows vertical conveying sections 30 and 40, bypass conveying section 50 and folding conveyance section 60.

Conveyance roller 301, conveyance rollers 402-405 and conveyance roller 501 are provided respectively on vertical conveying section 30, vertical conveying section 40 and bypass conveying section 50, to convey the sheet.

Folding rollers 601 and 602 are provided on the folding conveyance section 60, and pressure-contact roller 603 is in pressure contact with folding roller 601, while, pressure-contact roller 604 is in pressure contact with folding roller 602.

Folding rollers 601 and 602 are driven by a driving device (not shown) to rotate, and pressure-contact rollers 603 and 604 are driven respectively by the folding rollers 601 and 602.

Folding process and pamphlet production will be described as follows, referring to FIGS. 3 and 4.

First, folding process will be described.

Sheet P1 to be folded is conveyed to folding conveyance section 60 from vertical conveying section 40 to travel upward, and it stops when its folding line arrives at an intermediate position between roller 601 and roller 602. In this conveyance step, as shown in FIG. 4(*a*), folding roller 601 is away from folding roller 602, folding roller 601 and folding roller 602 rotate respectively in X1 direction and X2 direction, and sheet P1 is conveyed upward in FIG. 4(*a*).

Further, in this stage, guide member G3 is in its retracted position where the upward traveling of sheet P1 is not disturbed.

The suspension of conveyance by the folding rollers 601 and 602 is conducted at the point of time that has passed, by a prescribed period of time, from the detection of a leading edge of the sheet by sheet sensor SE1 arranged at the upstream side of the folding roller. This prescribed period of time is determined by a size of the sheet and by a type of folding.

Figure 4:
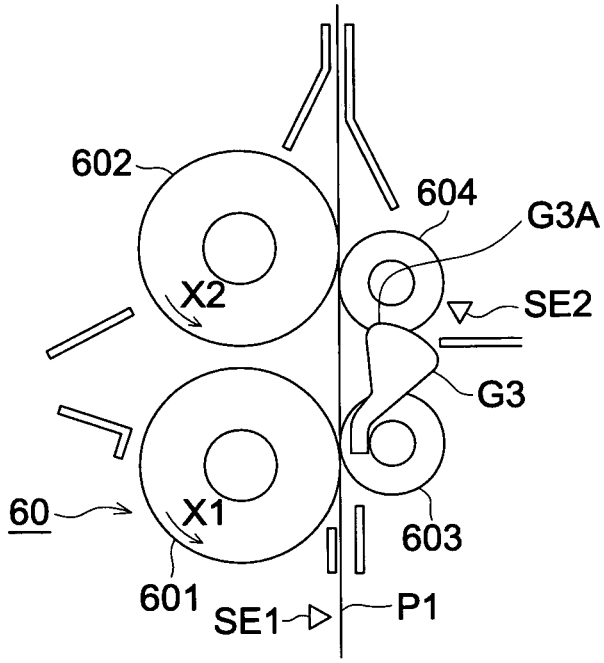
FIG. 4 is a diagram showing a folding conveyance section.
Figure 4:
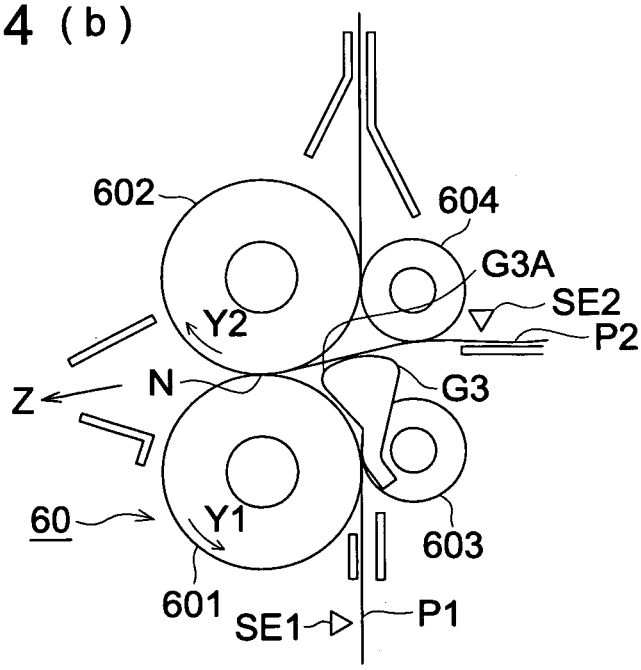

At the point of time when the folding line arrives at an intermediate position between the folding roller 601 and the folding roller 602, the folding roller 602 moves to come in pressure-contact with the folding roller 601, and guide member G3 rotates counterclockwise around the rotary shaft of pressure-contact roller 603 to move to the position in FIG. 4 (*b*) where tip G3A of the guide member G3 is close to the folding rollers 601 and 602.

When the guide member G3 is under the condition shown in FIG. 4 (*b*), the tip G3A pushes sheet P1 to be between the folding roller 601 and the folding roller 602, and to be curved.

Then, the folding rollers 601 and 602 rotate respectively in the directions of Y1 and Y2, to force the sheet P1 into nip N.

Owing to the continuation of rotation of the folding rollers 601 and 602, the folded sheet P1 is conveyed in the direction of arrow Z to be ejected to sheet-ejection tray 23 by sheet-ejection roller 22 through horizontal conveyance section 20.

In the processing to produce a pamphlet, sheet P1 is conveyed through the conveyance process described above, and the sheet P1 is stopped at the point of time when its folding line arrives at an intermediate position between the folding rollers 601 and 602.

Further, the guide member G3 moves to the position shown in FIG. 4 (*b*), as described above.

Owing to this movement, bypass conveying section 50 is formed and conveyance of sheet P2 to be interposed is made possible as shown in FIG. 4(*b*).

Sheet P2 conveyed through vertical-conveying section 30 under this condition is conveyed to folding conveyance section 60 from bypass conveying section 50.

At the point of time when a leading edge of the sheet P2 arrives at sheet P1, the folding rollers 601 and 602 rotate respectively in the directions of arrow Y1 and arrow Y2, to fold sheet P1 and to interpose sheet P2 in sheet P1 simultaneously, thus, a pamphlet is produced.

The pamphlet is ejected to sheet-ejection tray 23 by sheet-ejection roller 22 through horizontal-conveyance section 20.

The suspension of conveyance of sheet P2 is conducted at the point of time that has passed, by a prescribed period of time, from the detection of a leading edge of the sheet by sheet-sensor SE2 arranged in the vicinity of an outlet of bypass conveying section 50, and the conveyance of the sheet P2 is stopped at the sheet timing when a leading edge of the sheet P2 hits the sheet P1 firmly.

Figure 5:
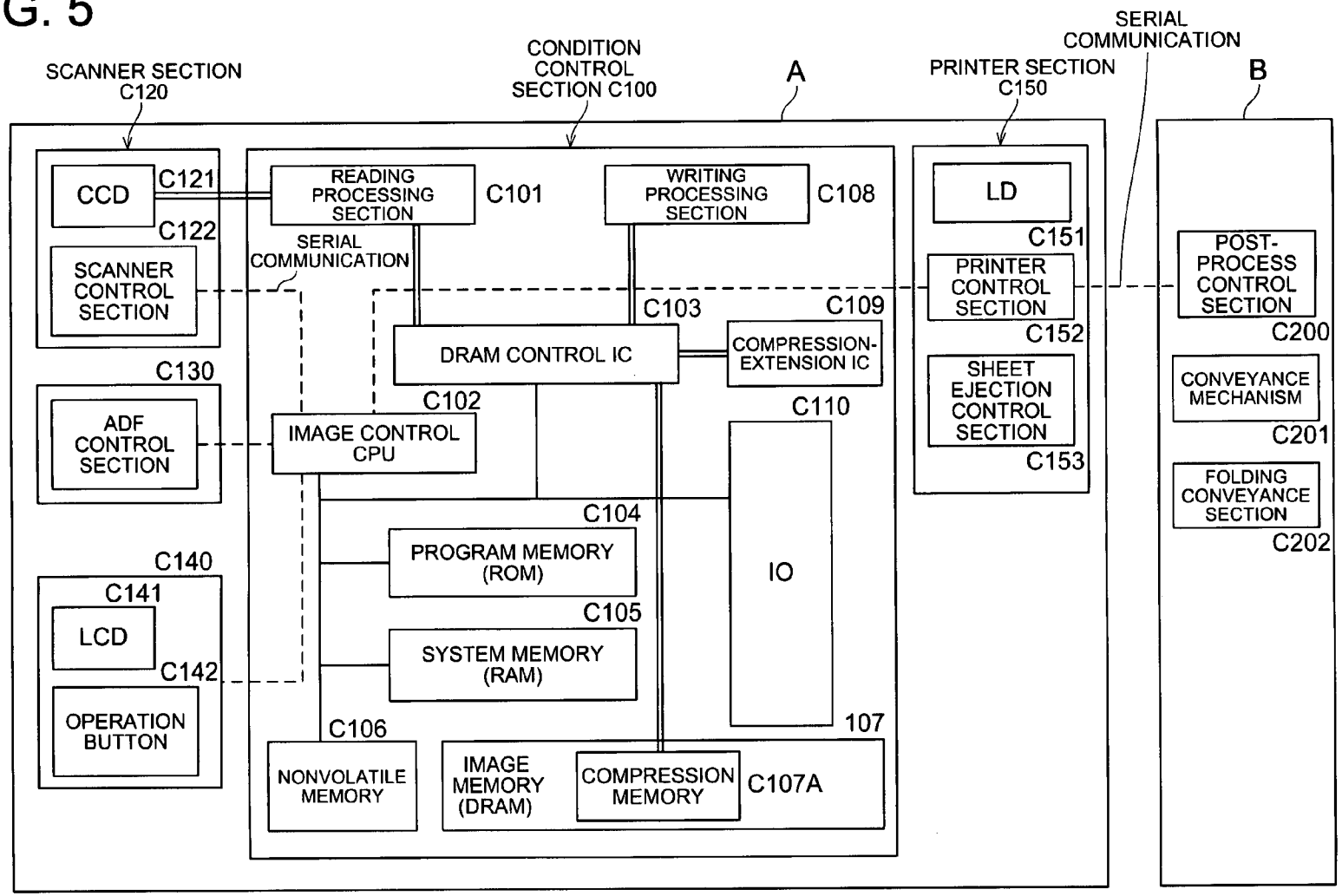
FIG. 5 is a block diagram of a control system for an image forming system shown in FIG. 1.

FIG. 5 is a block diagram of a control system for an image forming system shown in FIG. 1.

Image forming apparatus A has therein condition control section c100, scanner section c120, ADF control section c130, operation control section c140 and printer control section c150.

The condition control section c100 is one for controlling the whole of the image forming apparatus A and for conducting image data processing, and it has therein reading processing section c101, DRAM control IC c103, image control CPU c102, program memory c104, system memory c105, nonvolatile memory c106, writing controlling section c108, compression-extension IC c109 and input/output interface c110.

The reading processing section c101 conducts various types of image processing such as magnification varying and gradation processing for image data coming from scanner section c120.

The image control CPU c102 conducts synchronization control for scanner control section c122, ADF control section c130 and printer control section c152.

The DRAM control section c103 conducts control of writing/reading for image data.

The program memory c104 is a ROM housing therein control programs of image forming apparatus A and of image forming system, while, the system memory c105 is a RAM for the work.

The nonvolatile memory c106 houses therein various types of parameters used for control of various sections.

The symbol c107 represents a memory that stores image data, and it has therein compression memory c107A.

The symbol c108 represents a writing control section that controls LD (laser diode) representing an exposure light source for printer section c150.

The symbol c110 represents an interface that conducts communication with outer equipment such as PC (personal computer).

The scanner section c120 is equipped with CCD c121 that reads images and outputs image signals and with reading control section c122.

Operation/display section c140 has LCD c141 that conducts display and various types of operation buttons c142.

The printer section c150 has therein LD (laser diode) c151 that conducts image writing, printer control section c152 that controls various sections forming an image through electrophotographic process, and sheet-ejection control section c153.

The sheet-ejection control section c153 conducts switching between face-up sheet-ejection and face-down sheet-ejection for the sheets.

Post-processing apparatus B has therein post-process control section c200, conveyance mechanism c201 and folding conveyance section c202.

Figure 6:
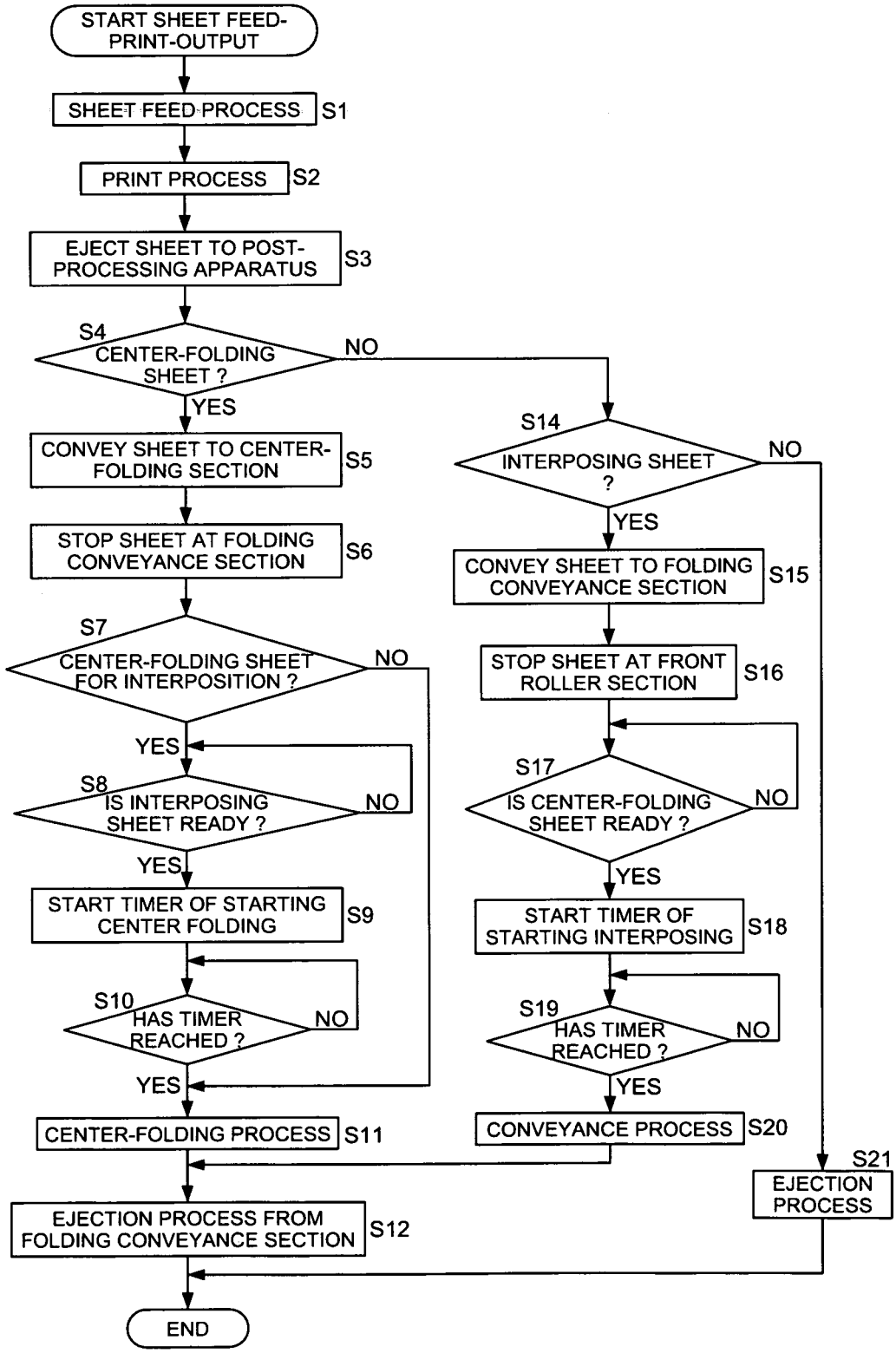
FIG. 6 is a flow chart of image forming processes accompanied by post-processing composed of folding-interposing processing.

FIG. 6 is a flow chart of image forming processes accompanied by post-processing composed of folding-interposing processing. The image forming processes shown in FIG. 6 will be described as follows, referring to FIG. 1 and FIG. 5 together.

In the image forming processes covering from image forming to post-processing shown in FIG. 6, image forming and post-processing are conducted for each set of sheets constituting a pamphlet, and finished pamphlets are ejected successively to sheet-ejection tray 23.

Therefore, for example, when producing pamphlets each having four pages, pamphlets are produced through the processes wherein image forming apparatus A forms images for 1-4 pages to produce the first pamphlet, and then, the image forming apparatus A forms images for 1-4 pages to produce the second pamphlet.

In step S1, a sheet is conveyed from sheet supply section 6A.

An image is formed on a sheet in step S2, and the sheet on which the image is formed is ejected to post-processing apparatus B in step S3.

In step S4, a sheet is judged whether it is sheet P1 to be folded or sheet P2 to be interposed.

When the sheet is judged to be the sheet P1, it is conveyed to folding conveyance section 60 (step S5).

In step S6, the sheet P1 is stopped temporarily at the position of the folding conveyance section 60. This position of the stop is a position where the folding line of the sheet P1 has arrived at an intermediate position between folding roller 601 and folding roller 602.

The folding line is formed on the center line of sheet P1 in many cases, but it is formed at a position that is off the center line occasionally depending on a shape of a pamphlet to be produced.

In step S7, the sheet P1 is judged whether it is a sheet for simple folding, or it is a sheet to be folded for conduction of an interposition process.

When the sheet is one to be folded for conduction of an interposition process (step S7; YES), the sheet waits until completion of preparation for interposing in step S8.

The completion of preparation for interposing means a process of detecting a passage of a leading edge of sheet P2 which is interposed, by sensor SE2.

In step S9, a center-folding start timer is started, and at completion of the timer (step S10), post-processing is started (step S11).

A center-folding timer in steps S9 and S10 creates a period of time during which the sheet P2 to be interposed is cause to hit the sheet P1 to be center-folded firmly.

In step S12, the sheet P1 in which the sheet P2 is interposed is folded and is ejected to sheet-ejection tray 23.

When the sheet P1 is judged not to be a sheet to be folded for the interposition in step S7, the process moves from step S7 to step S11, so that folding process is conducted and ejection is carried out (S12).

When the sheet is judged not to be a sheet to be folded in step S4, the process moves to step S14, and the sheet is judged whether it is sheet P2 to be interposed or not.

When the sheet is judged to be sheet P2 to be interposed, the sheet P2 is conveyed toward folding conveyance section 60 (step S15) and is stopped before the folding conveyance section 60 (step S16).

In step S17, a judgment is made whether preparation for folding is completed or not and an interposing timer is started at step S18, and sheet P2 is conveyed after completion of the timer (step S18).

Completion of preparation for folding in step S17, means a step of detecting that a leading edge of sheet P1 to be folded has passed through sensor SE1.

Steps S17-S20 represent processes which form a counterpart to processes of steps S8-S11 for sheet P1, and owing to these processes, sheet P2 to be interposed hits sheet P1 to be folded while keeping a right position, and thereby, a pamphlet wherein sheet P1 and sheet P2 are overlapped each other under the right alignment is produced and is ejected to sheet-ejection tray 23.

Incidentally, a judgment in each of steps S4 and S14 is made in accordance with a sheet conveyance program in the course of producing a pamphlet.

Embodiment 2

Figure 7:
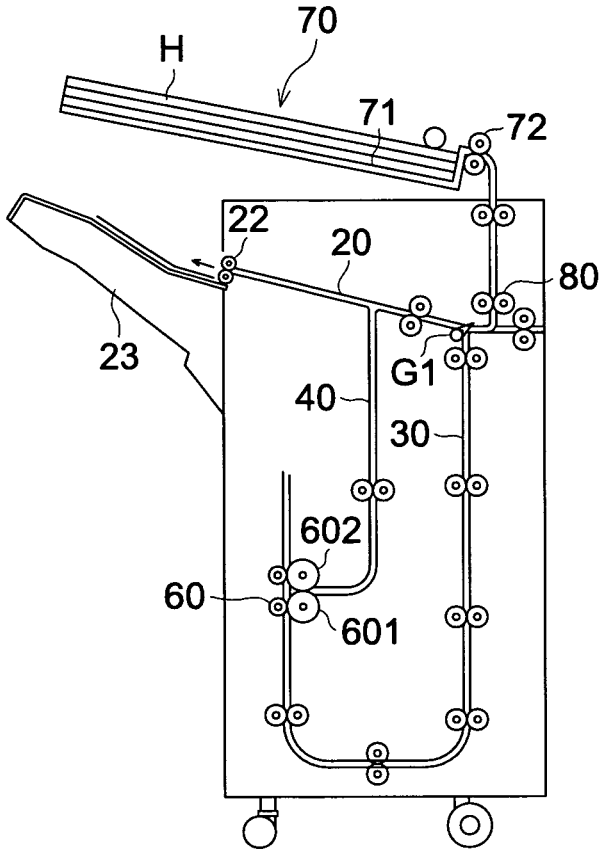
FIG. 7 is a diagram showing post-processing apparatus B relating to Embodiment 2 of the invention.

FIG. 7 shows post-processing apparatus B relating to Embodiment 2 of the invention.

Post-processing apparatus B has therein sheet supply section 70 and sheet superimposing section 80 representing an interposing device, in addition to the aforesaid horizontal conveyance section 20, the vertical conveyance sections 30 and the folding conveyance-section 60.

The sheet supply section 70 has therein sheet tray 71 that stores sheet P1 to be folded and sheet feed conveyance section 72, and supplies sheet P1 to sheet superimposing section 80.

The sheet superimposing section 80 superimposes sheet P1 coming from the sheet supply section and sheet P2 ejected from image forming apparatus A together, and then, conveys a bundle of sheets to vertical conveyance sections 30

Production of a pamphlet in the present embodiment will be described as follows, referring to FIGS. 7 and 8.

Figure 8:
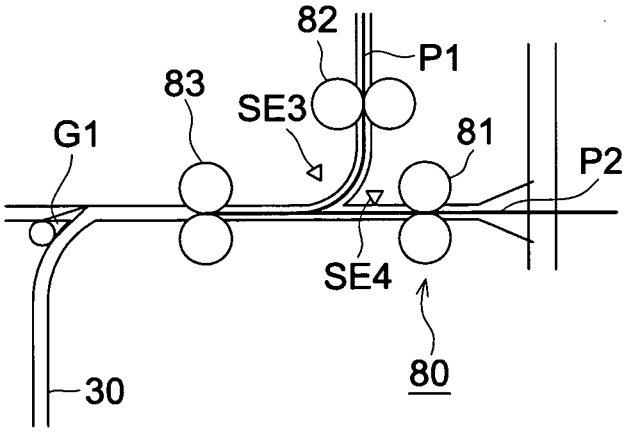
FIG. 8 is a diagram showing sheet superimposing section 80.

FIG. 8 shows sheet superimposing section 80.

Sheet P1 to be folded supplied from sheet supply section 70 is stopped under the state where a leading edge of the sheet P1 has arrived at conveyance roller 83, by a suspension of the conveyance roller 82 based on the detection signals for the leading edge by sheet sensor SE3.

Sheet P2 to be interposed ejected from image forming apparatus A is stopped under the state where a leading edge of the sheet P2 has arrived at conveyance roller 83, by a suspension of the conveyance roller 81 based on the detection signals for the leading edge by sheet sensor SE4.

Owing to the foregoing, the leading edge of the sheet P1 to be folded is aligned with that of the sheet P2 to be interposed.

Next, conveyance roller 83 rotates to convey sheet P1 and sheet P2 under the condition where these sheets are overlapped, and these sheets are guided by switching gate G1 to be conveyed to vertical conveying section 30.

The sheet P1 and sheet P2 are conveyed through vertical conveying section 30 to advance to folding conveyance section 60.

When a folding line of the sheet P1, namely, a trailing edge of the sheet P2 arrives at an intermediate position between folding roller 601 and folding roller 602, sheet conveyance by folding rollers 601 and 602 is stopped.

The folding conveyance section 60 has a structure shown in FIG. 4, folding operations of folding rollers 601 and 602 are as described above, and sheet P1 is center-folded, while sheet P2 is interposed in sheet P1, thus, a pamphlet is formed.

In the present embodiment, sheet P2 is superimposed in advance at sheet superimposing section 80 to be conveyed to folding conveyance section 60, without being attached to sheet P1 at the folding conveyance section 60.

In the folding conveyance section 60, sheet P1 is subjected to center-folding at a position of the trailing edge of sheet P2.

Figure 9:
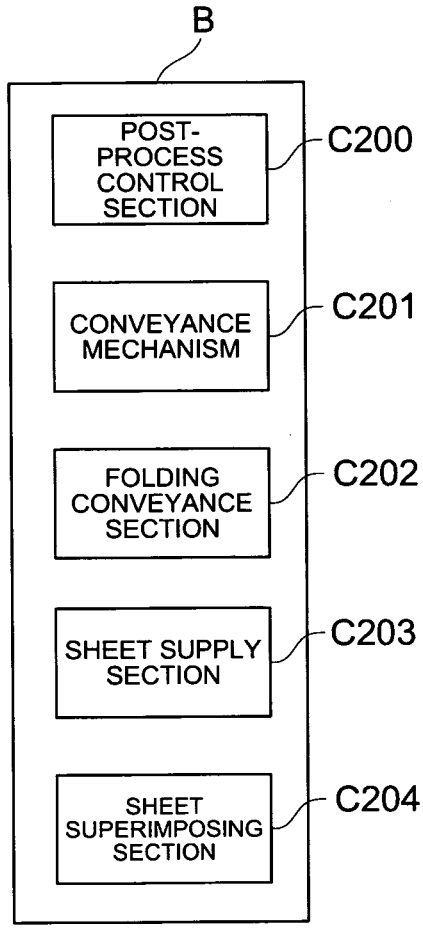
FIG. 9 is a block diagram showing a control system for post-processing apparatus B.
Figure 10:
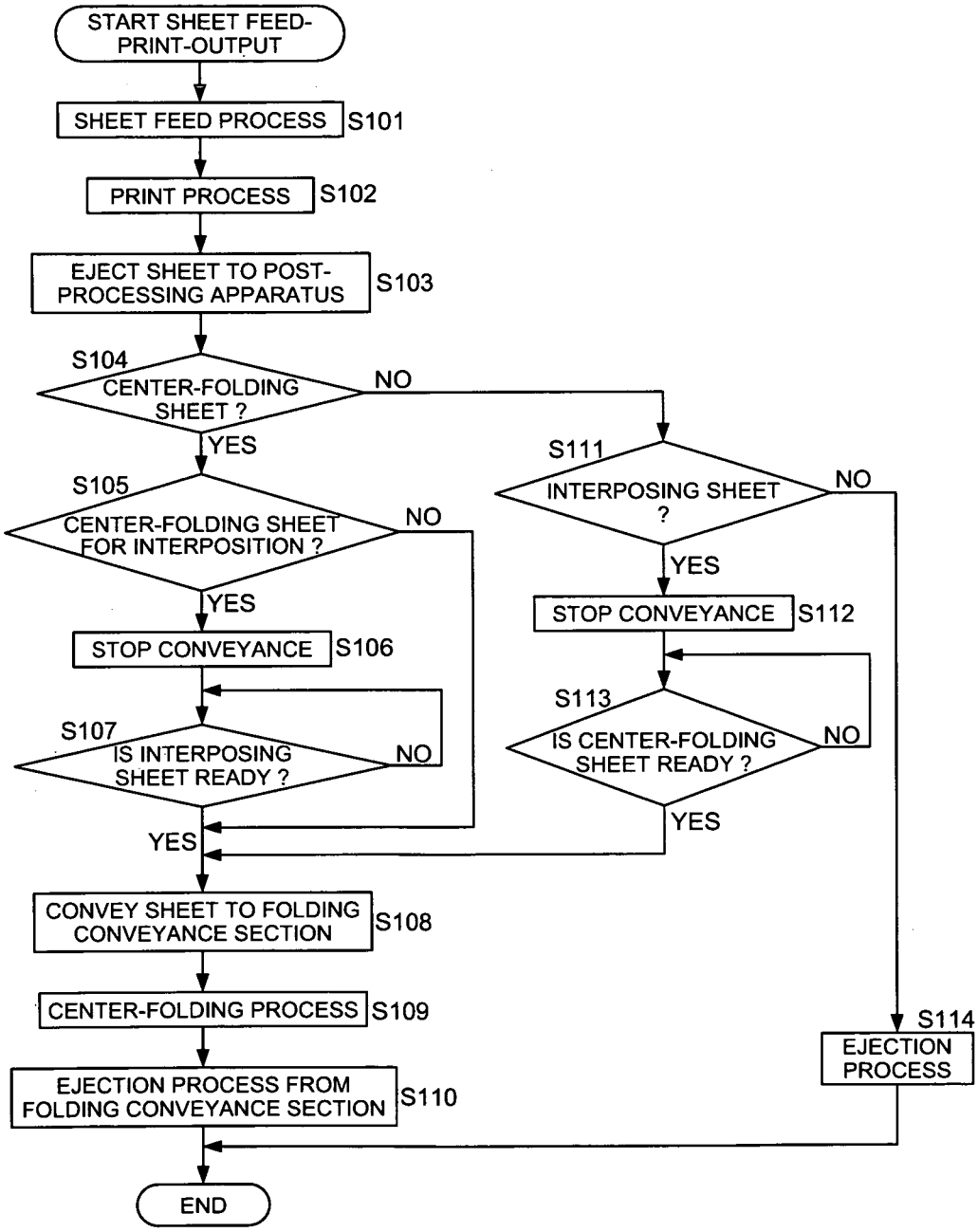
FIG. 10 is a flow chart of image forming processes in Embodiment 2.

FIG. 9 is a block diagram showing a control system for post-processing apparatus B, and FIG. 10 is a flow chart of image forming processes in Embodiment 2.

The post-processing apparatus B has therein post-process control section c200, conveyance mechanism c201, folding conveyance section c202, sheet supply section c203 and sheet superimposing section c204.

Steps S101-S103 are conducted in the same way as in steps S1-S3 in the Embodiment 1.

In step S104, a sheet is judged whether it is sheet P1 to be folded or not, and when it is sheet P1, it is judged whether it is sheet P1 to be folded for interposition, in step S105.

When a sheet is judged to be sheet P1 to be folded for interposition in step S105, the sheet P1 is stopped before the conveyance roller 83 in step S106.

In step S107, the sheet waits until completion of preparation for a sheet to be interposed.

Step S107 is a step wherein sheet P2 to be interposed is ejected from image forming apparatus A, and signals acquired through detection of a leading edge of a sheet by sensor SE4 provided on horizontal conveyance section 20 are monitored.

When the sheet is judged not to be sheet P1 to be folded in step S104, the sheet is judged in step S111 whether it is sheet P2 to be interposed or not.

When the sheet is judged to be sheet P2 to be interposed, the sheet P2 is stopped at this side of the conveyance roller 83 in step S112.

In step S113, the sheet waits until completion of preparation for a sheet to be folded.

Step S113 is a step wherein sheet P1 to be folded is ejected from sheet supply section 70, and signals acquired through detection of a leading edge of a sheet by sensor SE3 provided on the sheet feed path from sheet supply section 70 are monitored.

A step for waiting for completion of preparation in each of step S107 and step S113 is one for aligning a leading edge of sheet P1 with that of sheet P2 before conveyance roller 83.

In step S108, sheet P1 and sheet P2 are conveyed, while they are overlapped, to folding conveyance section 60, then, in step S109, the sheets are subjected to folding processing, and in step S110, they are ejected to sheet-ejection tray 23.

When the sheet is judged not to be sheet P2 to be interposed in step S111, the sheet is conveyed without being stopped, and is ejected to sheet-ejection tray 23.

Embodiment 3

Figure 11:
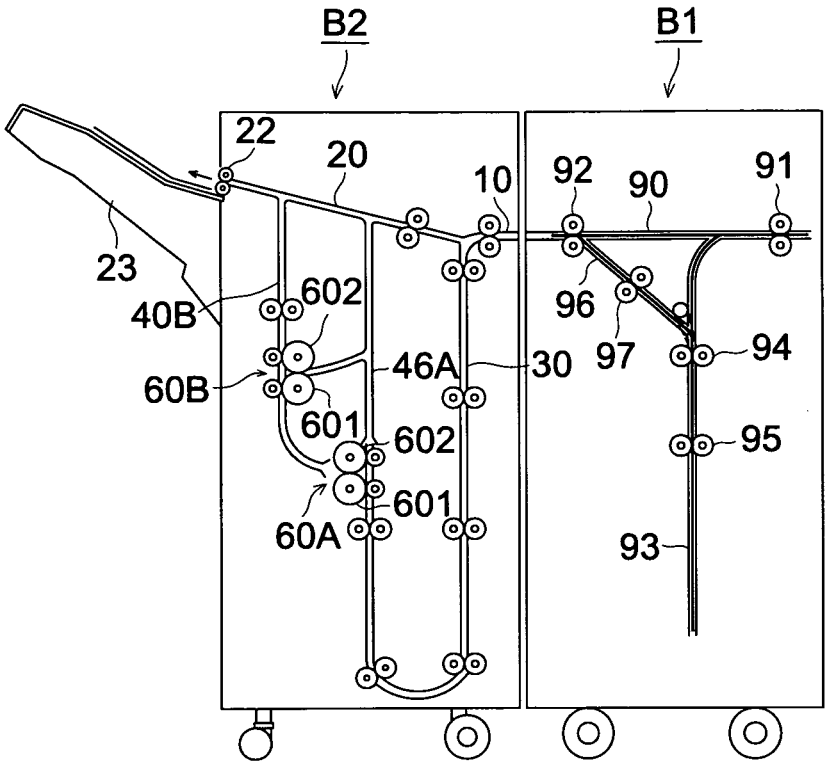
FIG. 11 is an overall view of the post-processing apparatus in Embodiment 3.
Figure 12:
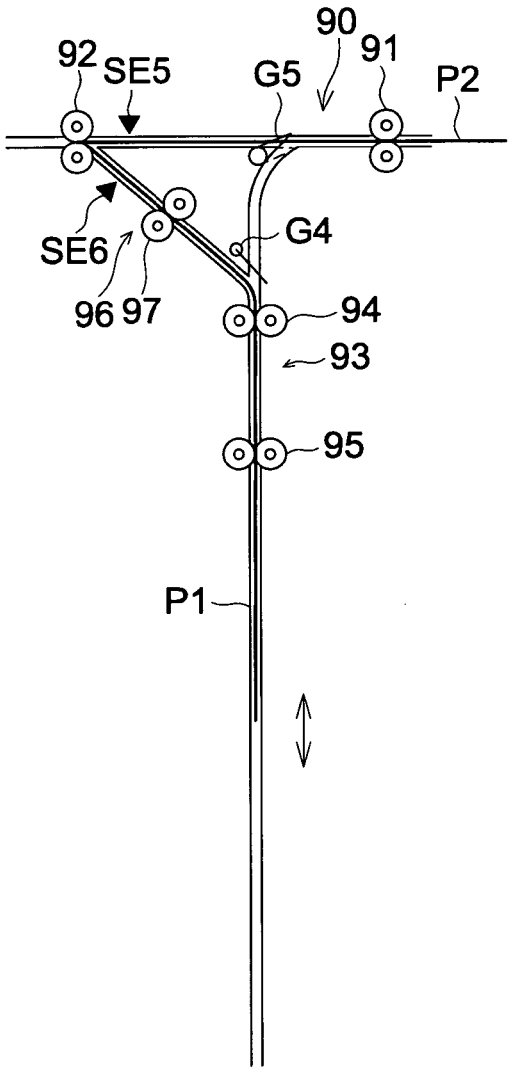
FIG. 12 is a diagram showing a conveyance path of the post-processing apparatus in Embodiment 3.
Figure 12:
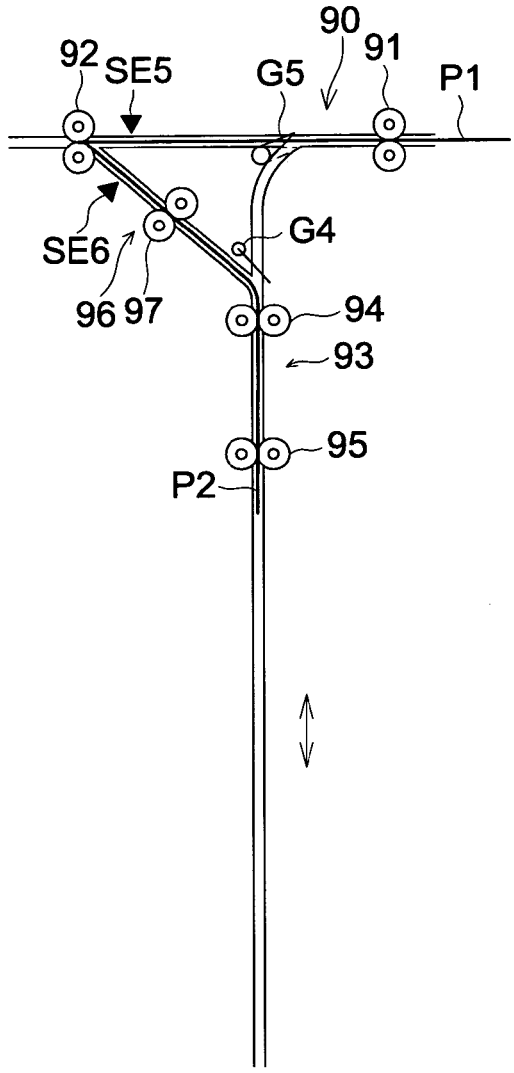

FIGS. 11 and 12 represent diagrams showing post-processing apparatuses of the Embodiment 3 in the invention. FIG. 11 is an overall view of the post-processing apparatus, and FIG. 12 is a diagram showing a conveyance path of the post-processing apparatus.

The post-processing apparatus is equipped with post-processing apparatuses B1 and B2, and the post-processing apparatus B1 reverses and conveys a sheet, and the post-processing apparatus B2 conducts center-folding and interposing processing for the sheet.

Post-processing apparatus B1 has therein horizontal conveyance section 90, reversing conveyance section 93 and reversing sheet-ejection section 96.

The horizontal conveyance section 90 is equipped with carry-in roller 91, sheet sensor SE5 and sheet-ejection roller 92.

Reversing conveyance section 93 has conveyance rollers 94 and 95, and reversing sheet-ejection section 96 has conveyance roller 97 and sheet sensor SE6.

Switching gate G5 guides a sheet by switching it to horizontal conveyance section 90 or reversing conveyance path 93.

Guide member G4 is a one-way guide member, and it guides the sheet to be conveyed through reversing conveyance section 93 downward, and it guides the sheet conveyed upward through reversing conveyance section 93 to reversing sheet-ejection section 96.

Post-processing apparatus B2 has therein horizontal conveyance section 20, vertical conveyance sections 30, 40A and 40B and folding conveyance sections 60A and 60B, and each of the folding conveyance sections 60A and 60B has a structure shown in FIG. 4 and is equipped with each of folding rollers 601 and 602.

Figure 13:
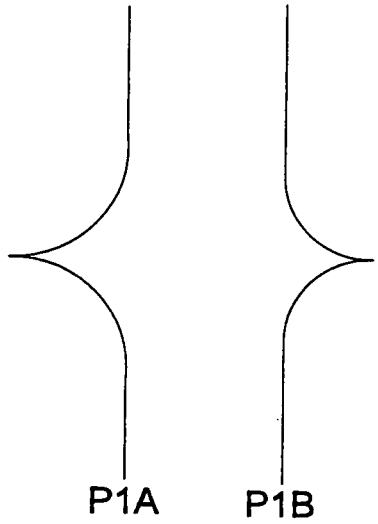
FIG. 13 is a diagram showing the direction of folding.

A direction of folding a sheet by the folding conveyance section 60A is opposite to that of folding a sheet by the folding conveyance section 60B, as shown by P1A and P1B in FIG. 13.

In the post-processing for producing a pamphlet employing post-processing apparatuses B1 and B2 shown in FIGS. 11 and 12, it is possible to conduct two types of processes described as follows.

(1) Process 1

After sheet P1 to be folded is ejected from image forming apparatus A and is conveyed into post-processing apparatuses B1, the sheet P1 is conveyed downward, through a guide of switching gate G5, to be conveyed through reversing conveyance section 93 by conveyance rollers 94 and 95, and is stopped at the position where the trailing edge of the sheet P1 has passed through guide member G4.

After the stopping of the sheet P1, the conveyance roller 95 is reversed in terms of its rotational direction to convey the sheet P1 upward.

The sheet P1 is conveyed to reversing sheet-ejection section 96 through a guide of guide member G4, and is stopped by signals of sheet sensor SE6 that has detected the leading edge of the sheet P1.

Next, sheet P2 to be interposed is ejected from image forming apparatus A, and is conveyed into post-processing apparatus B1.

The sheet P2 is guided by switching gate G5 to horizontal conveyance section 90, and is stopped by detection signals of sheet sensor SE5 that has detected the leading edge of the sheet P2.

Owing to the foregoing, the sheet P1 and the sheet P2 are at a stop at a position of sheet-ejection roller 92 under the condition that both of them are aligned in terms of their leading edges, as shown in FIG. 12 (*a*).

Next, the sheet-ejection roller 92 rotates to convey the sheet P1 and the sheet P2 into post-processing apparatus B2.

In the post-processing apparatus B2, sheet P1 is center-folded in folding conveyance section 60A in the same way as in FIG. 4, and a pamphlet is formed to be ejected to sheet-ejection tray 23.

Figure 16:
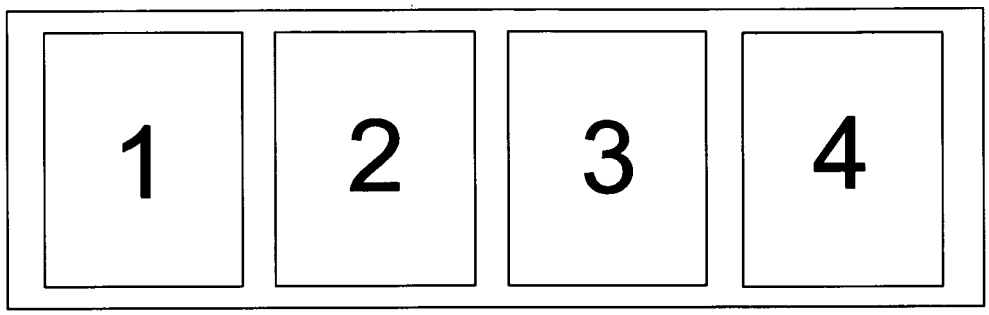
FIG. 16 is a diagram showing an example of a page allotment.
Figure 16:
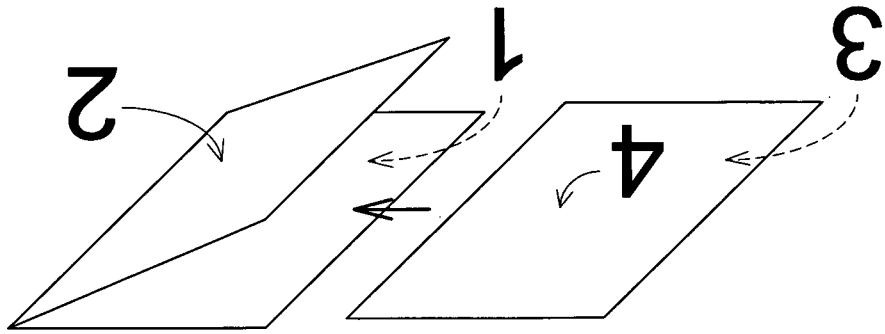
Figure 16:
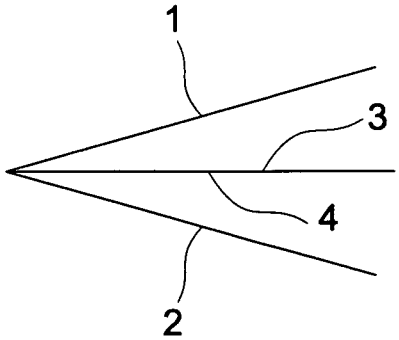
Figure 17:
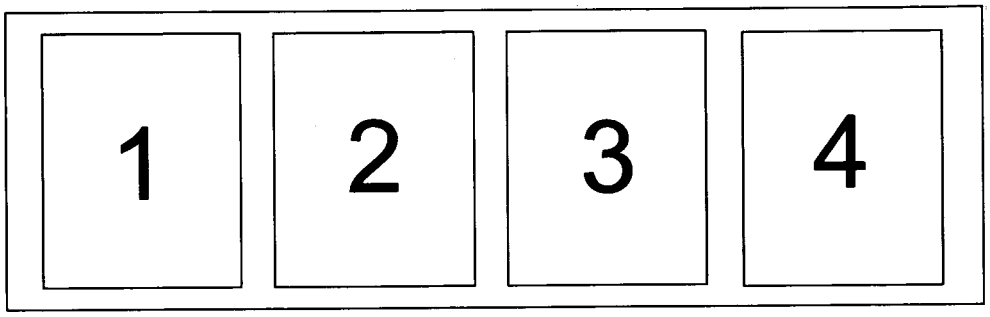
FIG. 17 is a diagram showing an example of a page allotment.
Figure 17:
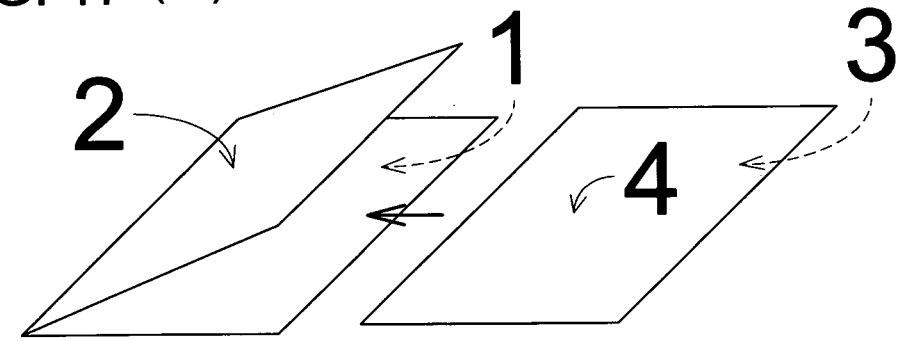
Figure 17:
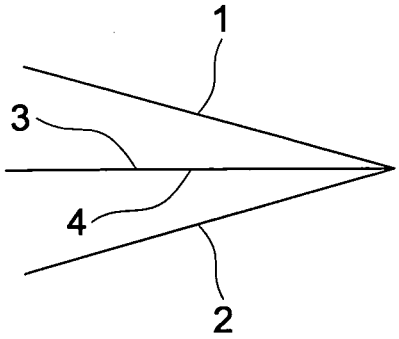

When producing a pamphlet shown in FIGS. 16 and 17 in the aforesaid processing, sheet P1 to be folded is ejected with its surface facing downward from image forming apparatus A.

(2) Process 2

After sheet P2 to be interposed is ejected from image forming apparatus A and is conveyed into post-processing apparatuses B1, the sheet P2 is conveyed downward, through a guide of switching gate G5, to be conveyed through reversing conveyance section 93 by conveyance rollers 94 and 95, and is stopped at the position where the trailing edge of the sheet P2 has passed through guide member G4.

After the stopping of the sheet P2, the conveyance rollers 94 and 95 are reversed in terms of a direction of rotation to convey the sheet P2 upward.

The sheet P2 is conveyed to reversing sheet-ejection section 96 through a guide of guide member G4, and is stopped by signals of sheet sensor SE6 that has detected the leading edge of the sheet P2.

Next, sheet P1 to be folded is ejected from image forming apparatus A, and is conveyed into post-processing apparatus B1.

The sheet P1 is guided by switching gate G5 to horizontal conveyance section 90, and is stopped by detection signals of sheet sensor SE5 that has detected the leading edge of the sheet P1.

Owing to the foregoing, the sheet P1 and the sheet P2 are at a stop at a position of sheet-ejection roller 92 under the condition that both of them are aligned in terms of their leading edges, as shown in FIG. 12 (*b*).

Next, the sheet-ejection roller 92 rotates to convey the sheet P1 and the sheet P2 into post-processing apparatus B2.

In the post-processing apparatus B2, sheet P1 is center-folded in folding conveyance section 60B in the same way as in FIG. 6, and a pamphlet is formed to be ejected to sheet-ejection tray 23.

In Process 2, when superimposing plural sheets P2 in the reversing conveyance section 93, a stopper (not illustrated), which is to be in contact with the lower end of the sheet P2, moves and stops at a position according to the sheet size, and the lower end of the sheet P2 hits the stopper and then positioning of the sheet is carried out while being rubbed by conveyance rollers 94 and 95. After this, the sheet P2 are conveyed to the reversing sheet-ejection section 96 while the plural sheets P2 are superimposed on each other, and it is possible to produce a pamphlet by interposing the plural sheets P2 to be interposed in a single sheet of sheet P1 to be folded, after superimposing the sheets P2 with the sheet P1.

When producing a pamphlet shown in FIGS. 16 and 17 in the aforesaid processing, sheet P1 to be folded is ejected with its surface facing upward from image forming apparatus A.

Figure 14:
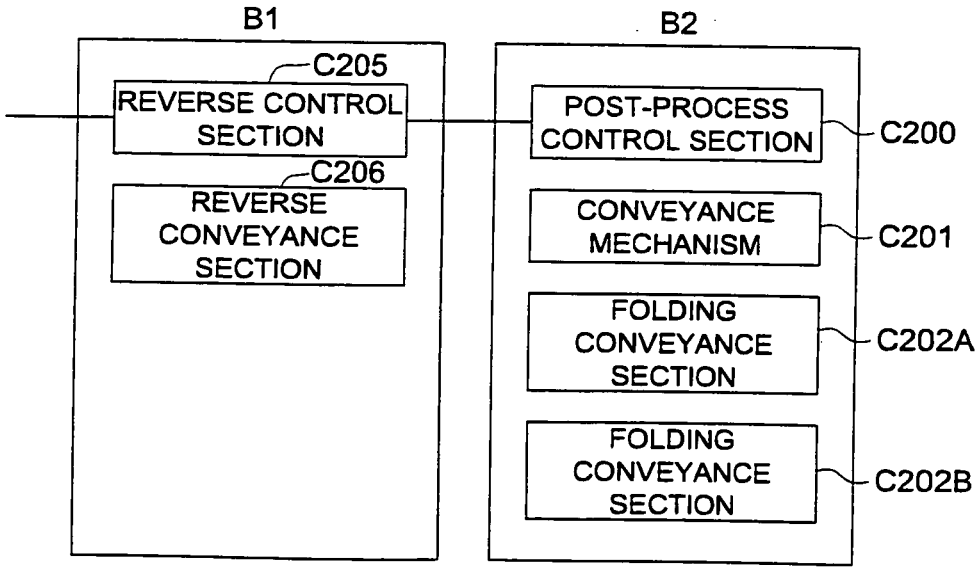
FIG. 14 is a block diagram showing a control system for the post-processing apparatus in Embodiment 3.
Figure 15:
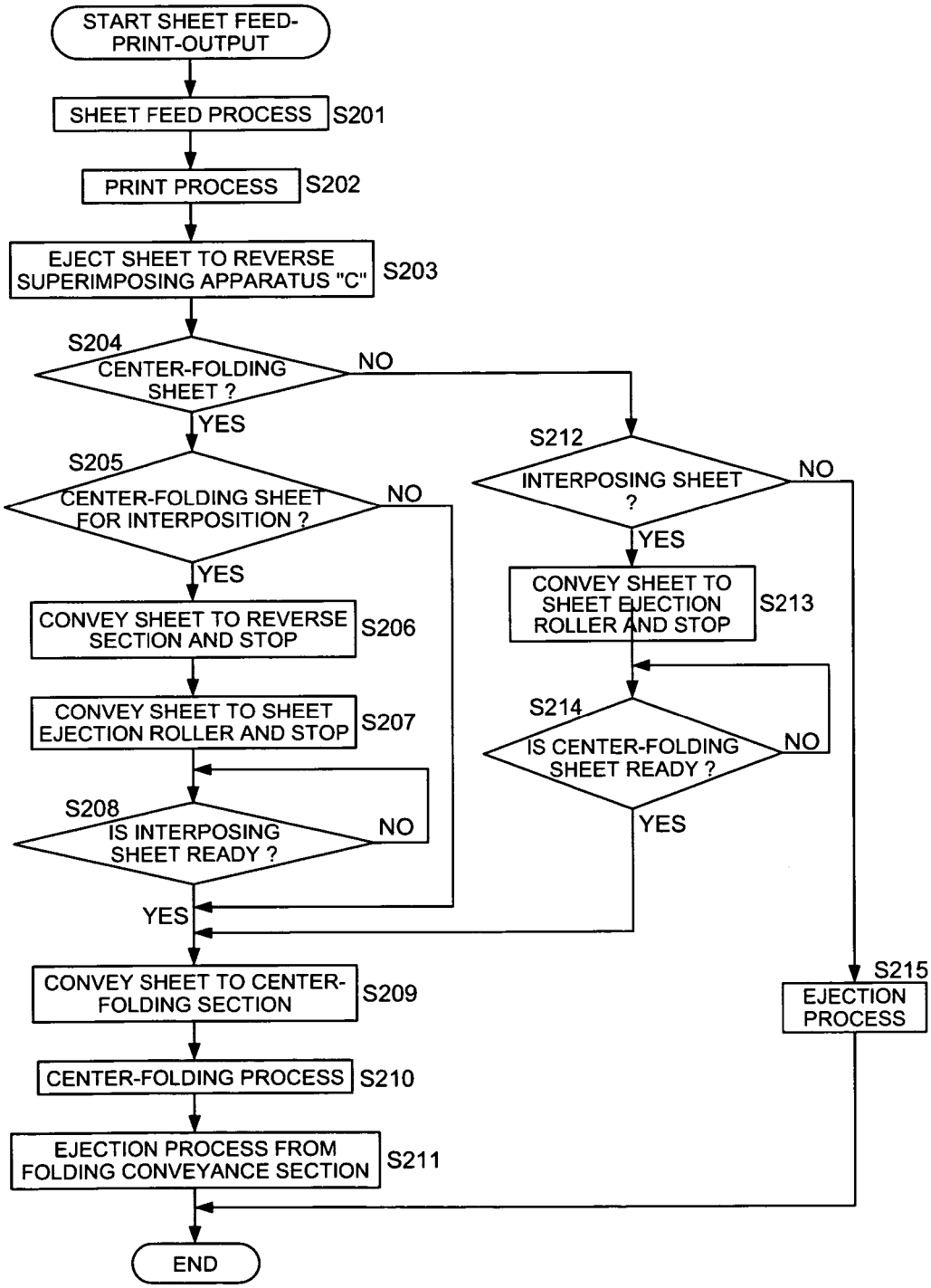
FIG. 15 is a flow chart of image forming processes in Embodiment 3.

FIG. 14 is a block diagram of a control system for the post-processing apparatus in Embodiment 3, and FIG. 15 is a flow chart of an image forming process in Embodiment 3.

In FIG. 14, the post-processing apparatus B2 has folding conveyance sections c202A and c202B representing control systems respectively corresponding to folding conveyance sections 60A and 60B in FIG. 11.

The post-processing apparatus B1 has reverse control section c205 and reverse conveyance section c206.

Incidentally, a post-processing process which will be described as follows is a process of the aforesaid processing 1.

Steps S201-S203 are conducted in the same way as in steps S1-S3 in the Embodiment 1.

In step S204, a sheet is judged whether it is sheet p1 to be folded or not, and when it is sheet P1 to be folded, it is judged whether it is sheet P1 to be folded for interposition, in step S205.

When the sheet is judged to be sheet P1 to be folded for interposition in step S205, the sheet P1 is conveyed to reversing conveyance section 93 to be stopped in step S206.

In step S207, sheet P1 is conveyed to a position before sheet-ejection roller 92, to be stopped there.

In step S208, the sheet waits until completion of preparation for a sheet to be interposed.

When the sheet is judged not to be sheet P1 to be folded in step S204, the sheet is judged in step S212 whether it is sheet P2 to be interposed or not.

When the sheet is sheet P2 to be interposed, the sheet P2 is conveyed to horizontal conveyance section 90 to be stopped there, in step S213.

In step S214, the sheet waits until completion of preparation for a sheet to be folded.

Stopping of sheet P1 in step S207 is conducted based on signals of leading edge detection of sheet sensor SE5, and stopping of sheet P2 in step S213 is conducted based on signals of leading edge detection of sheet sensor SE6.

Owing to the steps for waiting for completion of preparations respectively in steps S208 and 214, a leading edge of the sheet P1 is aligned with that of the sheet P2, and in step S211, the sheet P1 and the sheet P2 are superimposed together to be conveyed to folding conveyance section 60.

In step S211, the sheet P1 and the sheet P2 which have been folded and interposed respectively are ejected to sheet-ejection tray 23.

When the sheet is judged not to be sheet P2 to be interposed in step S212, the sheet is conveyed to horizontal conveyance section 90 to be ejected to post-processing apparatus B2 wherein the sheet is conveyed through horizontal conveyance section 20 to be ejected to sheet-ejection tray 23.

Next, page allocation of a pamphlet will be described.

As is apparent from the following description, page allocation desired by a user is possible in the present embodiment, because page allocation for sheets to be folded and page allocation for sheets to be interposed can be conducted independently.

Page allocation is conducted by image control CPU 102 representing an editing device.

Page allocation includes the following two types.

(1) Cover Type

A cover type is one wherein page allocation for sheets to be folded and page allocation for sheets to be interposed can be conducted independently.

FIG. 16 shows the first example of the cover type.

Image data are inputted in image control CPU 102 in the order of 1, 2, 3 and 4, as shown in FIG. 16 (*a*).

In the case of image output, page 1 and page 2 are allocated, as inverted images, on outer surfaces of sheet P1 to be folded, and page 3 and page 4 are allocated, as inverted images, on sheet P2 to be interposed, as shown in FIG. 16 (*b*).

In the present example, there is produced a pamphlet that opens from right to left wherein image areas can be seen in the order of page 1, page 3, page 4 and page 2 in the sequential opening.

FIG. 17 shows the second example of the cover type.

In the case of image output, page 2 and page 1 are allocated in this order, as upright images, on outer surfaces of sheet P1 to be folded, and page 4 and page 3 are allocated in this order, as upright images, on sheet P2 to be interposed, as shown in FIG. 17 (*b*).

In the present example, a pamphlet that opens from left to right is produced.

(2) Booklet Type

A booklet type is a type wherein images are allocated in the continuous page order through sheets to be folded and sheets to be interposed.

Figure 18:
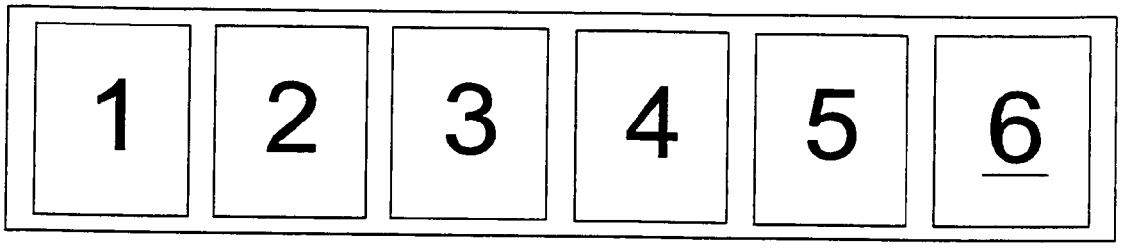
FIG. 18 is a diagram showing an example of a page allotment.
Figure 18:
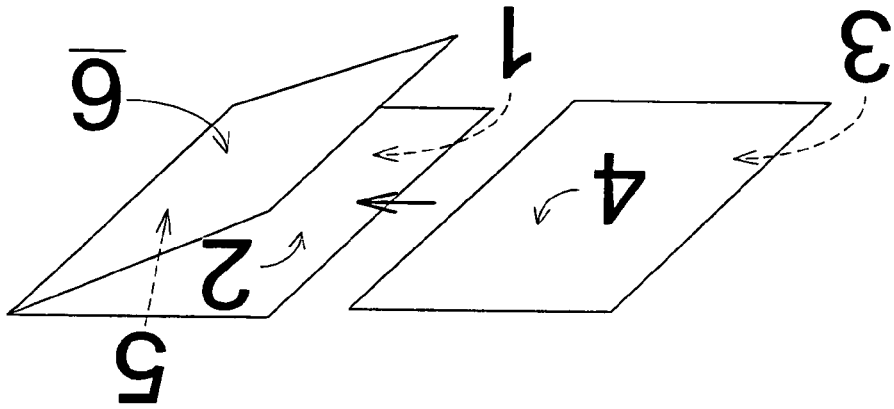
Figure 18:
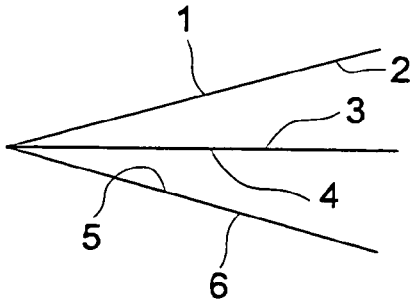

FIG. 18 shows an example of the booklet type.

With respect to the images inputted in the order from page 1 to page 6 as shown in FIG. 18 (*a*), page 1 and page 6 are formed on the outer surfaces of sheet P1 to be folded, page 5 and page 2 are formed on the inner surfaces of sheet P1 to be folded, and page 4 and page 3 are formed respectively on both sides of sheet P2 to be interposed, all as inverted images.

A pamphlet that opens from right to left is produced by page allocation shown in FIG. 18.

Operation procedures which are conducted by an operator in the case of practicing image forming process for producing a pamphlet will be described, referring to FIGS. 19-22.

As shown in FIG. 23, FIGS. 19-22 are examples of operations conducted from PC, in image forming system (Embodiment 4) wherein PCs are connected to image forming apparatus A and post-processing apparatus B through network N, and condition setting can also be conducted from operation control section c140 in FIG. 5. The PC in FIG. 23 and operation control section c140 in FIG. 5 constitute a condition setting device.

Figure 19:
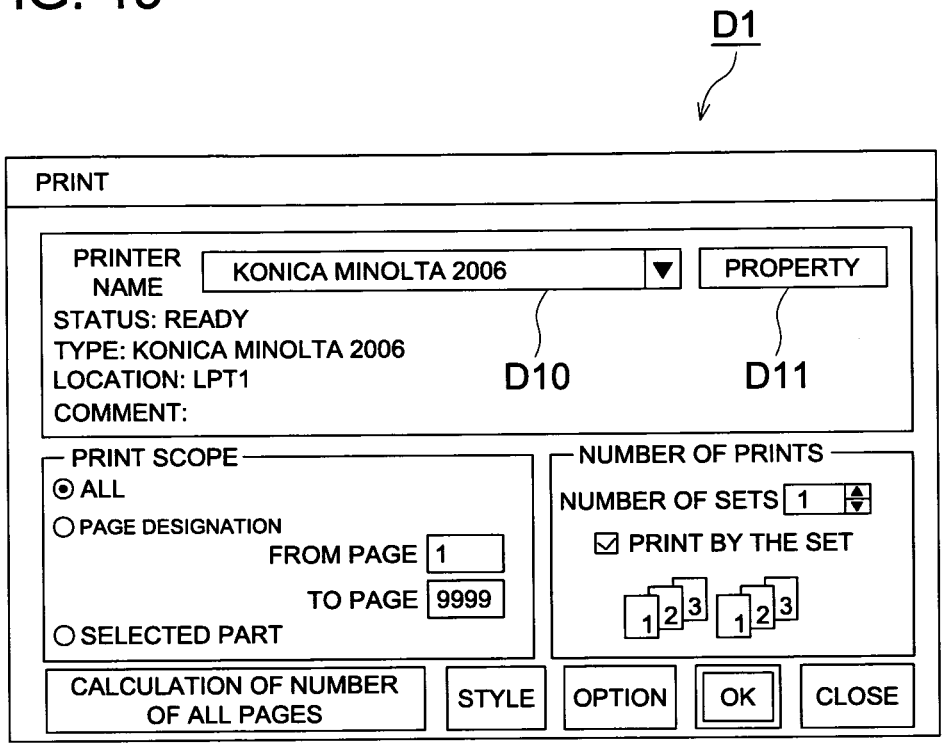
FIG. 19 is a diagram showing a screen for setting conditions.

FIG. 19 shows screen D1 that instructs printing.

An output destination is confirmed by D10, and property D11 button is pressed.

Figure 20:
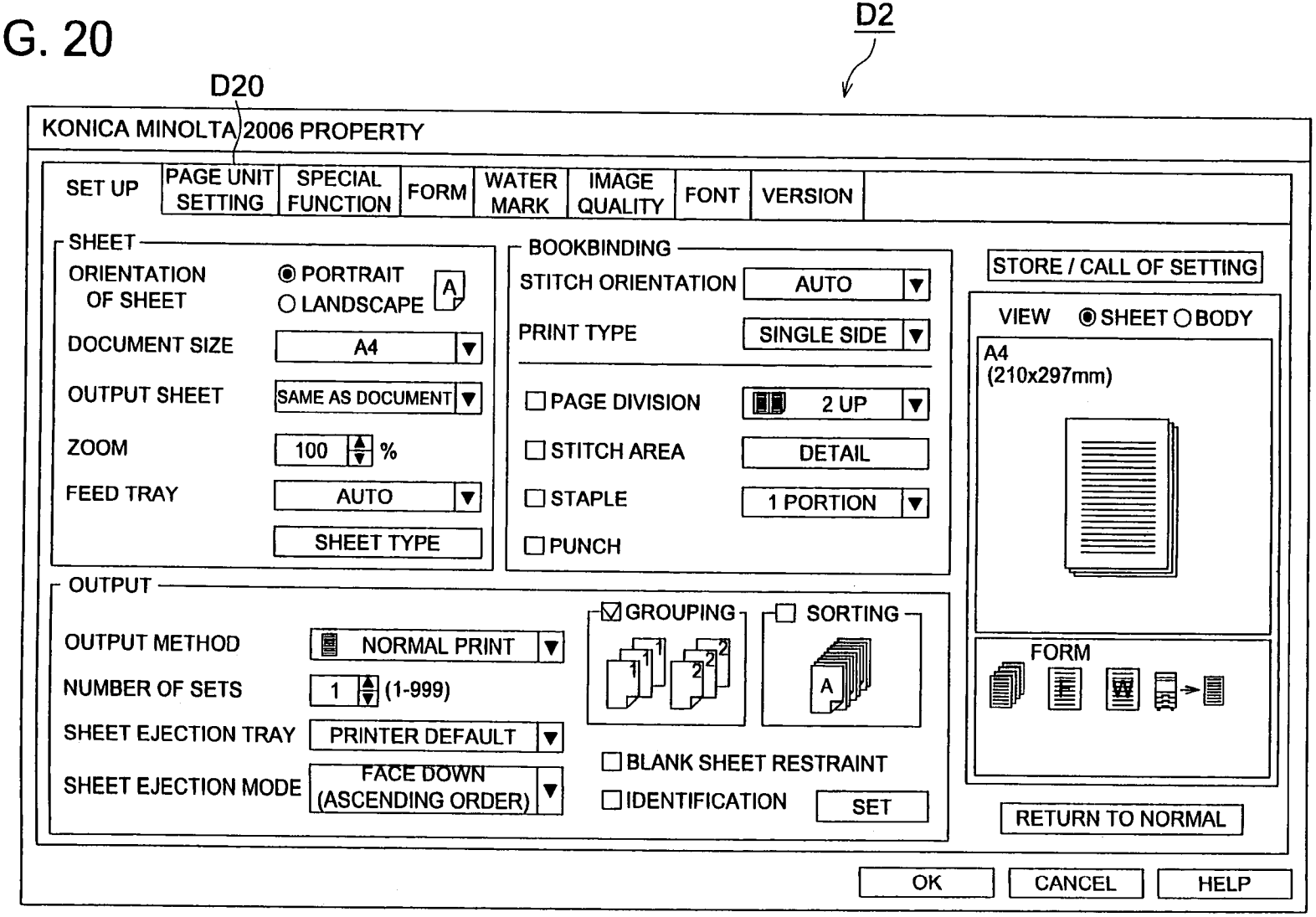
FIG. 20 is a diagram showing a screen for setting conditions.

Property screen D2 in FIG. 20 appears.

Page unit setting tab D20 is pressed after confirming various types of output conditions.

Figure 21:
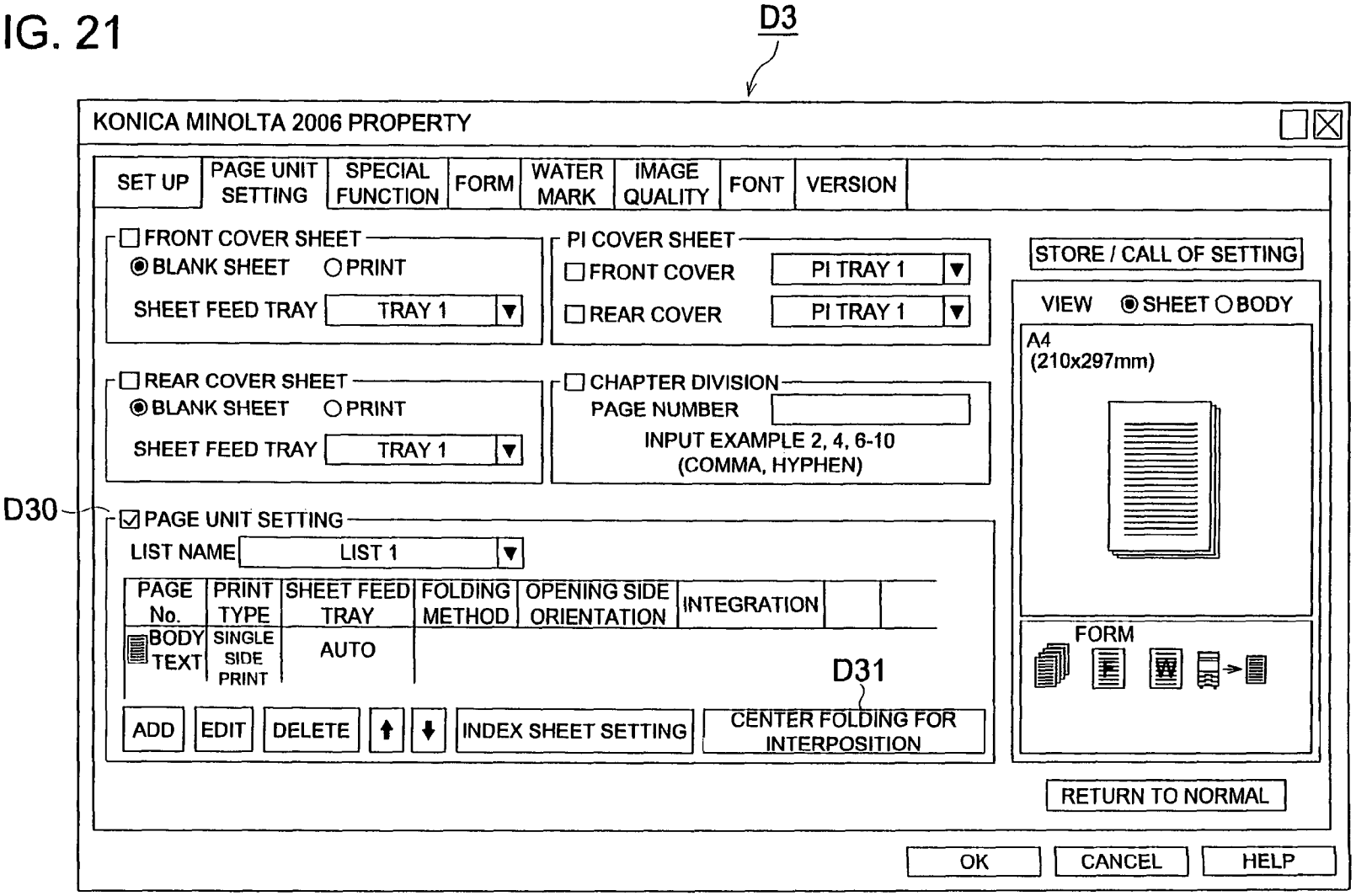
FIG. 21 is a diagram showing a screen for setting conditions.

Screen D3 for page unit setting in FIG. 21 appears, and center-folding for interposition button D31 is pressed by making check box D30 of page unit setting to be effective on the screen D3.

Figure 22:
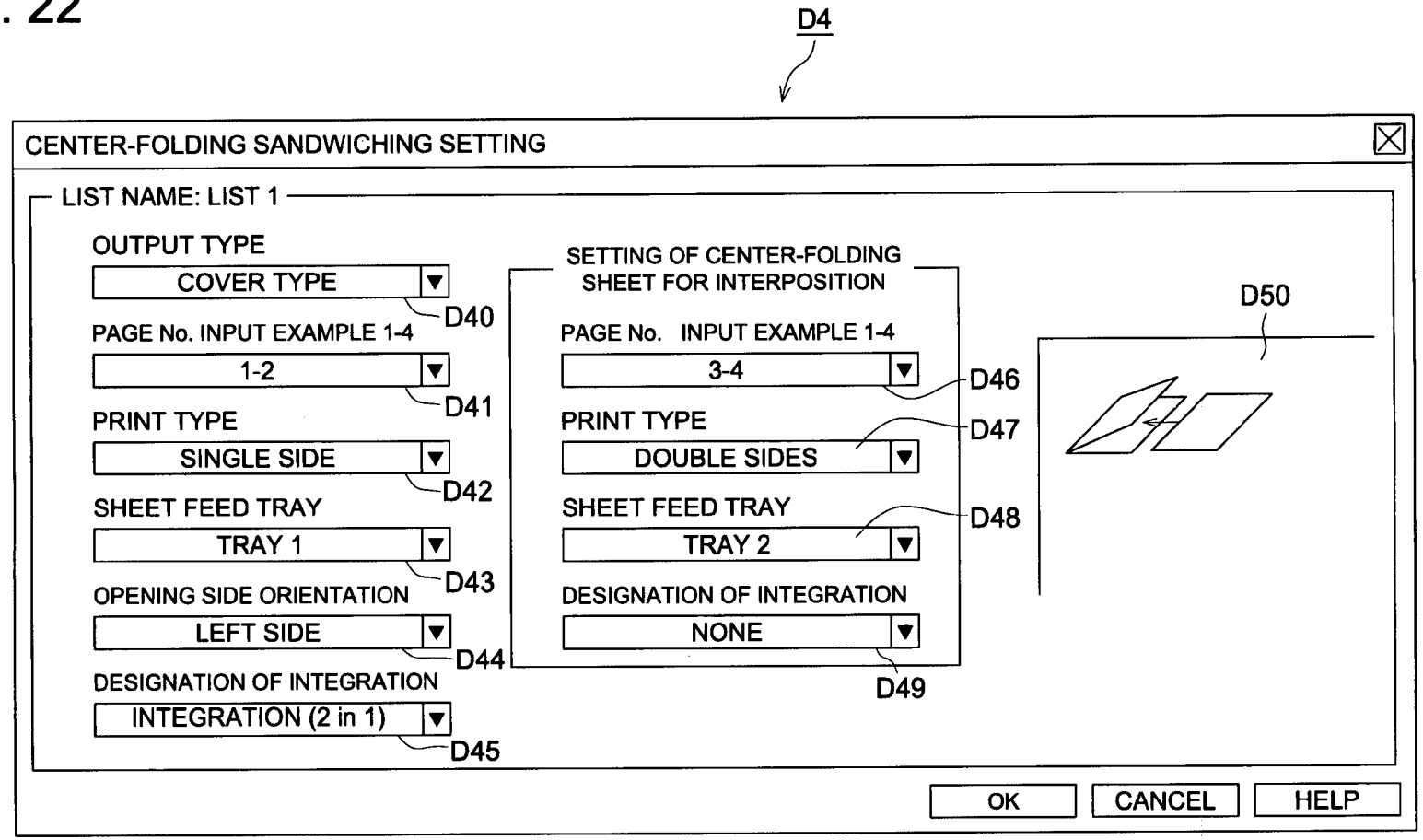
FIG. 22 is a diagram showing a screen for setting conditions.
Figure 23:
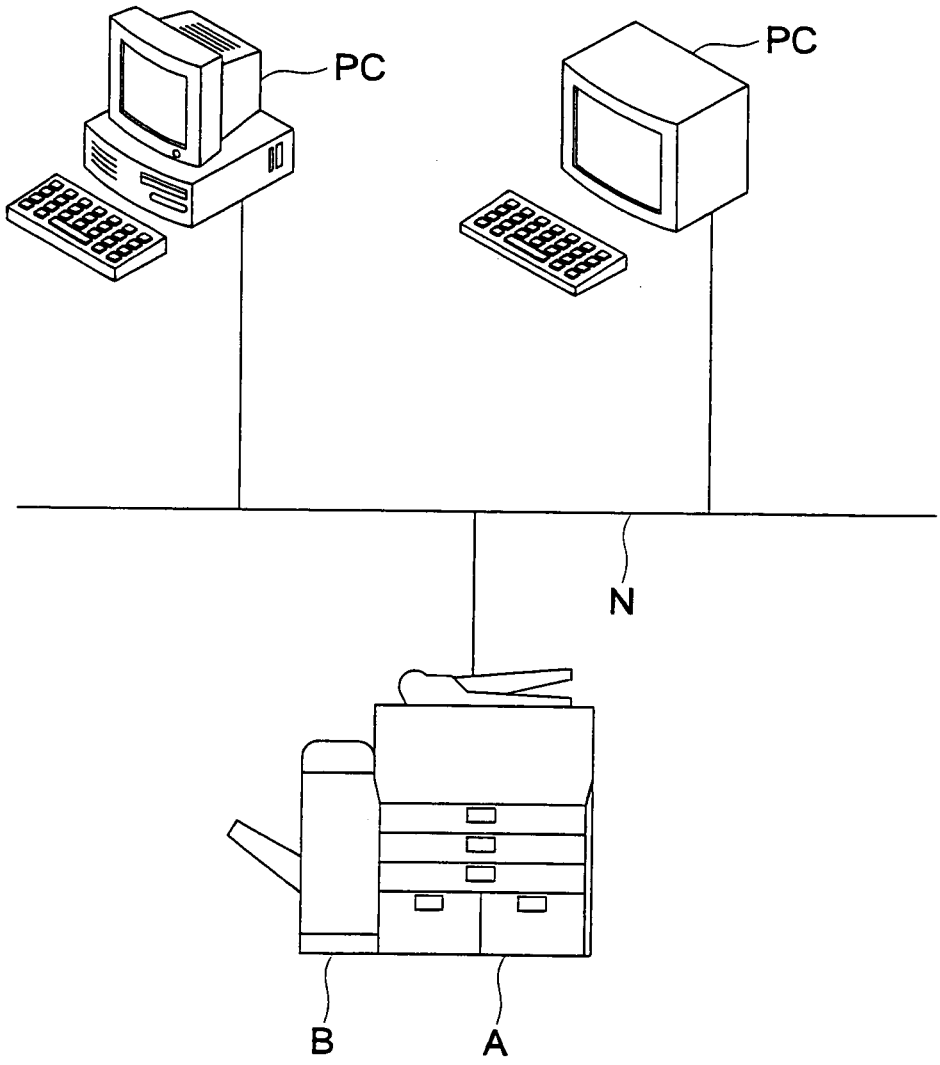
FIG. 23 is a diagram showing Embodiment 4 of the invention.

Center-folding for interposition screen D4 in FIG. 22 appears, and an image of a pamphlet is displayed like D50.

On output type D40, the illustrated cover type and an unillustrated booklet type can be selected.

D41-D45 represent setting for the sheet for center-folding.

Items for setting include page number D41, print types (single-sided/double-sided) D42, sheet supply tray D43, opening side orientation D44 and integration setting D45, for the sheet for center-folding.

Integration setting is a selection of whether to set (2 in 1) or not.

D46-D49 represent setting for the sheet to be interposed.

Items for setting include page number D46, print types (single-sided/double-sided) D47, sheet supply tray D48, and designation of integration D49.

When setting a booklet type in the output type, unillustrated predetermined items of setting corresponding to D41-D45 for the sheet to be folded and the sheet to be interposed are displayed, and setting for each of them is possible.

In the present embodiment, it is possible to produce a pamphlet by interposing a sheet in a folded sheet, and to eject the produced pamphlets one after another into a sheet ejection tray to pile them up. Thus, it is possible to produce pamphlets without making the sheet ejection section to be large in size, and to produce pamphlets in desired quantity without any restriction of the number of sets to be produced.

What is claimed is:

1. An image-forming system comprising:

an image forming apparatus for forming an image on a sheet for every set of sheets comprising a pamphlet; and a post-processing apparatus for processing a sheet on which an image has been formed, the post-processing apparatus comprising:

a folding device comprising two paired folding rollers for folding a sheet, the two rollers being capable of contacting each other and separating from each other, and at least one of the two rollers being rotatable in normal and reverse directions;

an interposing device for superimposing a sheet to be interposed on the sheet to be folded;

a conveying section for conveying the sheet to be interposed to the interposing device; and an ejection device for ejecting a pamphlet which has been formed by interposing the sheet to be interposed in the sheet to be folded, wherein after the pair of folding rollers conveys the sheet to be folded to a prescribed position while the two rollers are separated, the two rollers press against each other, the at least one of the two rollers changes to rotate in the reverse direction, and the sheet to be folded is folded in a state in which the sheet to be interposed has been made to meet the sheet to be folded by the interposing device, and wherein the interposing device comprises a guide member which guides the sheet to be interposed to the paired folding rollers while supporting the sheet to be interposed after the guide member comes close to the paired folding rollers while pushing the sheet to be folded, and conveys the sheet to be interposed by using the guide member so that a leading edge of the sheet to be interposed meets a folding line of the sheet to be folded and the folding device folds the sheet to be folded whose folding line has been met by the leading edge of the sheet to be interposed, the leading edge of the sheet to be interposed being a front edge thereof when the sheet to be interposed enters the interposing device from the conveying section.

2. The image forming system of claim 1, further comprising a sheet supply device for supplying the sheet to be folded in the image forming apparatus.

3. The image forming system of claim 1, further comprising a sheet supply device for supplying the sheet to be folded in the post-processing apparatus.

4. The image forming system of claim 1, further comprising an editing device for allocating pages on the pamphlet.

5. The image forming system of claim 4, wherein the editing device allocates a page to be formed on the sheet to be interposed independently from a page to be formed on the sheet to be folded.

6. The image forming system of claim 4, wherein the editing device allocates a page to be formed on the sheet to be interposed and a page to be formed on the sheet to be folded correlated with each other.

7. The image forming system of claim 1, further comprising a condition setting device for setting a condition for producing the pamphlet.

8. The image forming system of claim 7, wherein the image forming apparatus includes the condition setting device.

9. The image forming system of claim 7, further comprising an apparatus which includes the condition setting device and is connected with the image forming apparatus through a network.

10. A pamphlet producing method, the method comprising:

forming an image on at least a sheet to be interposed for every set of sheets comprising a pamphlet;

conveying a sheet to be folded;

conveying the sheet to be interposed by a conveying section;

conveying the sheet to be folded to a prescribed position by using two paired folding rollers while the two rollers are separated from each other, the two rollers being capable of contacting each other and separating from each other, and at least one of the two rollers being rotatable in normal and reverse directions;

aligning the sheet to be folded and the sheet to be interposed with each other by an interposing device;

producing the pamphlet by pressing the two rollers against each other, changing the at least one of the two rollers to rotate in the reverse direction after conveying the sheet to be folded to the prescribed position, and folding the sheet to be folded in a state in which the sheet to be interposed has been made to meet the sheet to be folded in the aligning; and ejecting the pamphlet;

wherein in the aligning, a folding line of the sheet to be folded is made to meet a leading edge of the sheet to be interposed by a guide member which guides the sheet to be interposed to the paired folding rollers while supporting the sheet to be interposed after the guide member comes close to the paired folding rollers while pushing the sheet to be folded, and the sheet to be folded whose folding line has been met by the leading edge of the sheet to be interposed is folded in the producing, the leading edge of the sheet to be interposed being a front edge thereof when the sheet to be interposed enters the interposing device from the conveying section.

* * * * *